United States Patent [19]

Shaw

[11] 4,288,247

[45] Sep. 8, 1981

[54] NICKEL-BASE SUPERALLOYS

[75] Inventor: Stuart W. Shaw, Sutton Coldfield, England

[73] Assignee: The International Nickel Company, Inc., New York, N.Y.

[21] Appl. No.: 54,308

[22] Filed: Jul. 2, 1979

[30] Foreign Application Priority Data

Jul. 6, 1978 [GB] United Kingdom ..... 28996/78

[51] Int. Cl.[3] ..... C22C 19/05

[52] U.S. Cl. ..... 75/171; 148/32.5

[58] Field of Search ..... 75/171, 170; 148/32, 148/32.5

[56] References Cited

U.S. PATENT DOCUMENTS 4,127,410 11/1978 Merrick et al. ..... 75/171

*Primary Examiner*—R. Dean

*Attorney, Agent, or Firm*—Raymond J. Kenny; Francis J. Mulligan, Jr.

[57] ABSTRACT

A nickel-base superalloy containing 14 to 22% chromium, 5 to 25% cobalt, 1 to 5% tungsten, 0.5 to 3% tantalum, 2 to 5% titanium, 1 to 4.5% aluminum, the sum of the titanium plus aluminum being 4.5 to 9%, up to 2% niobium, about 0.35 to 1.2% boron, up to 3.5% molybdenum, up to 0.5% zirconium, up to 0.2% total of yttrium and lanthanum, up to 0.1% carbon, at least 0.05% of at least one element of the group of hafnium and vanadium with the maximum being about 2.2% hafnium and 2% vanadium, the balance of the alloy being essentially nickel.

7 Claims, No Drawings

NICKEL-BASE SUPERALLOYS

This invention relates to nickel-base superalloys which are particularly suitable for the production of cast parts for use at elevated temperatures in corrosive atmospheres, such as, for example, in gas turbines.

In our application U.S. Ser. No. 867,753, U.S. Pat. No. 4,207,098 and Canadian Ser. No. 294,648, we described and claimed alloy compositions containing 14 to 22% chromium, from 5 to 25% cobalt, 1 to 5% tungsten, 0.5 to 3% tantalum, 2 to 5% titanium, 1 to 4.5% aluminum, the sum of the titanium plus aluminum being 4.5 to 9%, 0 to 2% niobium, more than 0.3 and up to 1.2% boron, 0 to 3.5% molybdenum, 0 to 0.5% zirconium, 0 to 0.2% in total yttrium or lanthanum or both, and 0 to 0.1% carbon, the balance, apart from impurities, being nickel.

Because of the close control and correlation of the alloy ingredients with each other, particularly with regard to boron and carbon, these alloys possess excellent properties and a good combination of strength, ductility and corrosion resistance in particular. The alloys are usefully prepared by standard casting techniques, for example vacuum melting and casting, to provide products having a equi-axed crystal structure.

However, it has now been found that an addition of one or both of hafnium and vanadium to these alloys is beneficial, particularly, although not exclusively, when they are produced by a chill casting route to provide castings having a columnar crystal structure.

It is an object of the present invention to provide a novel alloy suitable for the production of cast parts subject in use to high stress at high temperatures.

An alloy according to this invention contains, by weight, 14 to 22% chromium, 5 to 25% cobalt, 1 to 5% tungsten, 0.5 to 3% tantalum, 2 to 5% titanium, 1 to 4.5% aluminum, the sum of titanium plus aluminum being 4.5 to 9%, 0 to 2% niobium, more than 0.3, eg., 0.35 and up to 1.2% boron, from 0 to 3.5% molybdenum, 0 to 0.5% zirconium, 0 to 0.2% in total yttrium or lanthanum or both, and 0 to 0.1% carbon, the balance, apart from impurities being nickel, characterized in that the alloy additionally contains one or both of hafnium in an amount up to about 2.2% and vanadium in an amount up to 2.0%.

The addition of hafnium or vanadium generally improves the stress-rupture lives and the high temperature ductility of the alloys, particularly their transverse ductibility.

A minimum hafnium content of 0.05% is preferred and more preferably at least 0.1% is present. An advantageous upper limit for the hafnium content is 1.7%, a more advantageous one being 1.3%, and for optimum properties the hafnium content is at least 0.3% but no more than 1.2%, for example, 0.7 to 0.8%.

If vanadium is present, a minimum content of 0.05% is again preferably required and a preferred maximum content for this element is 1.5%. Most advantageously, the vanadium content is at least 0.5% but no more than 1.3%. The preferred ranges for the elements present in the alloys other than hafnium and vanadium are the same as those quoted in my previous application, as are the methods of preparation of the alloys and the heat treatments which may be employed to develop the full properties of the alloys. The disclosure of patent application U.S. Ser. No. 867,753, U.S. Pat. No. 4,207,098 and Canadian Ser. No. 294,648 is incorporated herein by reference.

Examples of hafnium- and vanadium-containing alloys are now given and their properties are compared with a hafnium- and vanadium-free alloy in accordance with our previous invention.

The alloys of the invention (Nos. 1 to 4) containing 19% to 21% by weight of chromium, i.e. 20% and the comparative alloy of the previous invention (a) together with a further comparative alloy (b) were all prepared in the same manner by vacuum melting in an induction furnace and vacuum casting via a mold lock into a mold whose walls had been heated to 1150° C. but whose base was placed upon a cold copper block which provided a chill base. Pouring into the mold was effected at 1650° C. and a standard exothermic compound placed on top of the liquid metal. The resulting castings, whose compositions are shown in Table I, were tapered bar blanks having a base diameter of 14 mm, a top diameter of 22 mm and a length of 90 mm. Their structure was columnar with crystals running along the whole length of the blanks.

TABLE I

| | Alloy Composition (% by Wt.) | | | | | |
|---|---|---|---|---|---|---|
| Element | 1 | 2 | 3 | A | B | 4 |
| Cr | 20 | 20 | 20 | 20 | 20 | 20 |
| C | 0.01 | 0.01 | 0.01 | 0.01 | 0.01 | 0.01 |
| Co | 15 | 15 | 15 | 15 | 15 | 15 |
| Mo | 0.5 | 0.5 | 0.5 | 0.5 | 0.5 | 0.5 |
| W | 2.2 | 2.2 | 2.2 | 2.2 | 2.2 | 2.2 |
| Nb | 1.0 | 1.0 | 1.0 | 1.0 | 1.0 | 1.0 |
| Ta | 1.5 | 1.5 | 1.5 | 1.5 | 1.5 | 1.5 |
| Ti | 3.6 | 3.6 | 3.6 | 3.6 | 3.6 | 3.6 |
| Al | 2.5 | 2.5 | 2.5 | 2.5 | 2.5 | 2.5 |
| Zr | 0.05 | 0.05 | 0.05 | 0.05 | 0.05 | 0.05 |
| B | 0.8 | 0.8 | 0.8 | 0.8 | 0.8 | 0.8 |
| Hf | 0.5 | 1.5 | — | — | 2.5 | 2.0 |
| V | — | — | 1.0 | — | — | — |
| Ni | Bal | Bal | Bal | Bal | Bal | Bal |

Prior to the machining of test pieces from the blocks, they were heat treated by solution heating for 4 hours at 1150° C., air cooling, and ageing for 16 hours at 850° C. The heat treated test pieces were then subjected to various stress rupture tests with results shown in Table II.

TABLE II

| | Results Stress Rupture 650N/mm$^2$ at 760° C. | |
|---|---|---|
| Alloy No. | Time (Hrs.) | Elongation (%) |
| 1 | 34 | 6.5 |
| 2 | 27 | 4.0 |
| 3 | 17 | 5.8 |
| A | 23 | 3.4 |
| B | 1.7 | 7.9 |
| 4 | 19 | 2.9 |

Comparison of alloy Nos. 1 and 2 with Alloy A shows that hafnium additions of 0.5 and 1.5 are beneficial to the high temperature ductility of the alloys as measured by the above elongation figures. Alloy 4 shows that 2.0% hafnium provides similarly good properties to those of Alloy A but that too much hafnium, i.e., the 2.5% hafnium of Alloy B, is very detrimental to strength.

Comparison of Alloy No. 3 with Alloy A shows the improved high temperature ductility arising from a vanadium addition of 1.0%.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. An alloy consisting essentially of, by weight, 19 to 21% chromium, 5 to 25% cobalt, 1 to 5% tungsten, 0.5 to 3% tantalum, 2 to 5% titanium, 1 to 4.5% aluminum, the sum of the titanium plus aluminum being from 4.5 to 9%, 0 to 2% niobium, 0.35 to 1.2% boron, 0 to 3.5% molybdenum, 0 to 0.5% zirconium, 0 to 0.2% in total of yttrium or lanthanum or both, and 0 to 0.1% carbon, the balance, apart from impurities, being nickel, characterized in that the alloy additionally contains one or both of hafnium in an amount up to 2.2% and vanadium in an amount up to 2.0%.

2. An alloy according to claim 1 containing a maximum of about 1.7% hafnium.

3. An alloy according to claim 1 containing at least 0.05% hafnium.

4. An alloy according to claim 1 containing at least 0.3% hafnium.

5. An alloy according to claim 1 containing at least 0.05% vanadium.

6. An alloy according to claim 5 containing a maximum of about 1.5% vanadium.

7. An alloy as in claim 1 containing about 20% chromium and about 15% cobalt.

* * * * *